US008918017B2

(12) United States Patent
Matsushita et al.

(10) Patent No.: US 8,918,017 B2
(45) Date of Patent: Dec. 23, 2014

(54) CARTRIDGE AND IMAGE FORMING APPARATUS WITH ELASTICALLY DEFORMABLE SHUTTER MEMBER

(75) Inventors: Masaaki Matsushita, Yokohama (JP); Tatsuo Fujisaki, Suntou-gun (JP); Kazuki Matsumoto, Fuji (JP); Toshiyuki Shuto, Oita (JP)

(73) Assignee: Canon Kabushiki Kaisha, Tokyo (JP)

( * ) Notice: Subject to any disclaimer, the term of this patent is extended or adjusted under 35 U.S.C. 154(b) by 290 days.

(21) Appl. No.: 13/005,177

(22) Filed: Jan. 12, 2011

(65) Prior Publication Data

US 2011/0170906 A1 Jul. 14, 2011

(30) Foreign Application Priority Data

Jan. 13, 2010 (JP) ..... 2010-004591
Dec. 9, 2010 (JP) ..... 2010-274388

(51) Int. Cl.
*G03G 21/18* (2006.01)

(52) U.S. Cl.
CPC .... *G03G 21/1832* (2013.01); *G03G 2221/1884* (2013.01)
USPC ..... 399/114

(58) Field of Classification Search
USPC ..... 399/114, 111
See application file for complete search history.

(56) References Cited

U.S. PATENT DOCUMENTS

| | | | | | |
|---|---|---|---|---|---|
| 5,266,999 | A * | 11/1993 | Yashiro | 399/114 |
| 5,791,930 | A * | 8/1998 | Tabata et al. | 439/345 |
| 6,002,896 | A * | 12/1999 | Miyamoto et al. | 399/114 |
| 6,236,822 | B1 * | 5/2001 | Kawaguchi | 399/114 |
| 2002/0131790 | A1 * | 9/2002 | Sato et al. | 399/111 |
| 2007/0237544 | A1 * | 10/2007 | Kawai | 399/111 |
| 2011/0020031 | A1 | 1/2011 | Sato et al. | |
| 2011/0058846 | A1 | 3/2011 | Hirukawa et al. | |

FOREIGN PATENT DOCUMENTS

| | | | |
|---|---|---|---|
| JP | 04046355 | A * | 2/1992 |
| JP | 9-26740 | A | 1/1997 |
| JP | 11095638 | A * | 4/1999 |

OTHER PUBLICATIONS

Translation of JP09-026740A to Nakagawa et al., Jan. 28, 1997.*

* cited by examiner

*Primary Examiner* — Quana M Grainger
(74) *Attorney, Agent, or Firm* — Fitzpatrick, Cella, Harper & Scinto

(57) ABSTRACT

A cartridge detachably mountable to a main assembly of the image forming apparatus includes an image bearing member; a frame having an opening for exposing the image bearing member; a movable shutter member movable between a closing position for closing the opening and an open position for opening the opening; and a holding portion for abutting to the shutter member to hold the shutter member at the closing position, wherein the shutter member is elastically deformable to ride over the holding portion to permit the shutter member to move from the closing position to the open position.

15 Claims, 6 Drawing Sheets

(a)

(b)

(a)

(b)

CARTRIDGE AND IMAGE FORMING APPARATUS WITH ELASTICALLY DEFORMABLE SHUTTER MEMBER

FIELD OF THE INVENTION AND RELATED ART

The present invention relates to a cartridge which is removably mountable in the main assembly of an image forming apparatus and does not require a pressure applying means to keep its shutter closed. It also relates to an image forming apparatus which employs such a cartridge.

In this specification, an "image forming apparatus" means an apparatus which forms an image on recording medium with the use of an electrophotographic image formation process. Examples of an image forming apparatus include an electrophotographic copy machine, an electrophotographic printer (laser beam printer and LED (light emitting diode) printer, for example), a facsimile apparatus, a word processor, and the like.

A "process cartridge" means a cartridge in which an electrophotographic photosensitive drum, and one or more means for processing the electrophotographic photosensitive drum, are integrally placed, and which is mountable in the main assembly of an image forming apparatus. Examples of processing means include a charging means, a developing means, a cleaning means, and the like.

In the field of an image forming apparatus which uses an electrophotographic image formation process, it has been a common practice to employ a process cartridge system, which integrally places an electrophotographic photosensitive member, and means for processing the electrophotographic photosensitive member, in a cartridge which is removably mountable in the main assembly of an electrophotographic image forming apparatus. A process cartridge system makes it possible for a user to maintain an electrophotographic image forming apparatus by him- or herself, that is, without relying on a service person. Thus, this system has come to be widely used in the field of an electrophotographic image forming apparatus.

Japanese Laid-open Patent Application H09-26740 discloses a process cartridge which is removably mountable in the main assembly of an image forming apparatus. This process cartridge has a rotatably movable shutter for protecting the photosensitive drum in the process cartridge. The shutter is attached to the frame of the process cartridge. It is enabled to move between its closed position and open position. The closed position is for protecting the photosensitive drum, whereas the open position is for keeping the photosensitive drum exposed from the frame of the process cartridge. Further, the shutter is kept under the pressure from a pressure applying means, such as a spring, with which the process cartridge is provided. Thus, until the process cartridge is mounted into the main assembly of an image forming apparatus, the shutter remains in its closed position. As the process cartridge is inserted into the main assembly of an image forming apparatus, the shutter comes into contact with the main assembly. Thus, as the process cartridge is inserted further into the main assembly, the shutter is moved from its closed position to its open position by the main assembly, against the pressure from the pressure applying means. On the other hand, as the process cartridge in the main assembly is moved outward of the main assembly to be moved out of the main assembly, the shutter is moved from its open position to its closed position by the pressure from the pressure applying means.

SUMMARY OF THE INVENTION

A process cartridge in accordance with the prior art described above requires a pressure applying means for keeping its shutter in the closed position while the process cartridge is out of the main assembly of an image forming apparatus. Moreover, when the process cartridge is assembled, the pressure applying means has to be attached to the shutter, and the frame of the process cartridge.

Thus, the primary object of the present invention is to provide a process cartridge, which is significantly smaller in the number of components related to its shutter, superior in terms of the efficiency with which it can be assembled, and yet, is as good as, or superior to, a process cartridge in accordance with the prior art, in terms of shutter function.

According to an aspect of the present invention, there is provided a cartridge detachably mountable to a main assembly of the image forming apparatus, comprising an image bearing member; a frame having an opening for exposing said image bearing member; a movable shutter member movable between a closing position for closing said opening and an open position for opening said opening; and a holding portion for abutting to said shutter member to hold said shutter member at the closing position, wherein said shutter member is elastically deformable to ride over said holding portion to permit said shutter member to move from the closing position to the open position.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

[Embodiment 1]

First, referring to FIGS. 1A, 1B and 2-4, the first preferred embodiment of the present invention is described.

[General Structure of Electrophotographic Image Forming Apparatus]

Figure 1A:
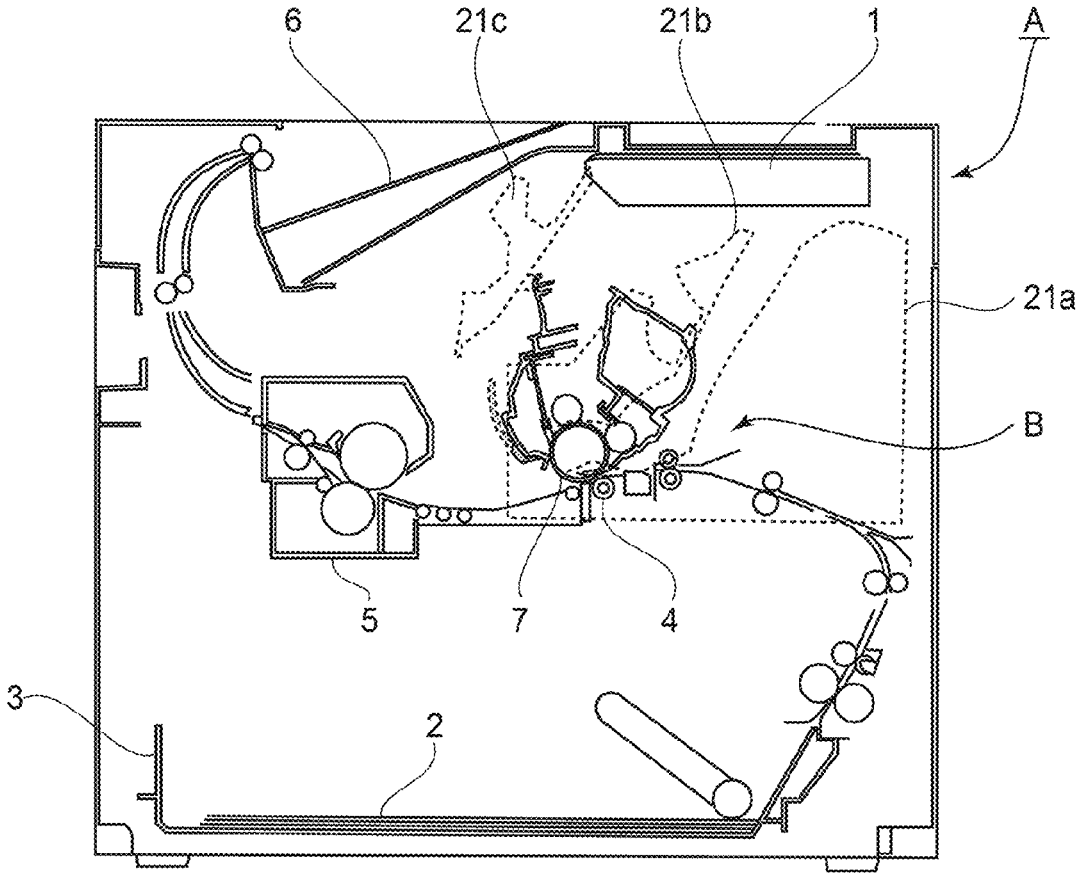
FIG. 1A is a schematic sectional view of the electrophotographic image forming apparatus when a process cartridge in the first preferred embodiment of the present invention is in the apparatus, and shows the general structure of the apparatus.

FIG. 1A is a schematic sectional view of the electrophotographic image forming apparatus (laser beam printer) in the first preferred embodiment of the present invention, when a process cartridge B, which is in accordance with the present invention, is in its proper position for image formation in the main assembly of the image forming apparatus. It shows the general structure of the image forming apparatus. First, the image forming apparatus in this embodiment is described with reference to FIG. 1A. The image forming operation of the image forming apparatus in this embodiment is as follows: First, a latent image is formed on the peripheral surface of a photosensitive drum 7 (image bearing member) by exposing the peripheral surface of the photosensitive drum 7 to the beam of laser light projected, while being modulated according to the information regarding the image to be formed, from an optical system 1. This latent image is developed into a visible image (toner image), that is, an image formed of toner, with the use of developer (which hereafter may be referred to as toner). In synchronism with the formation of the toner image, a sheet 2 of recording medium is moved out of a sheet feeder cassette 3, and is conveyed though the main assembly of the image forming apparatus. While the sheet 2 of recording medium is conveyed though the main assembly, the toner image on the photosensitive drum 7 is transferred onto the sheet 2 of recording medium by a transfer roller 4. Then, the toner image is fixed to the sheet 2 of recording medium by a fixing means 5. Then, the sheet 2 of recording medium is discharged into a delivery tray 6.

[Process Cartridge]

Figure 1B:
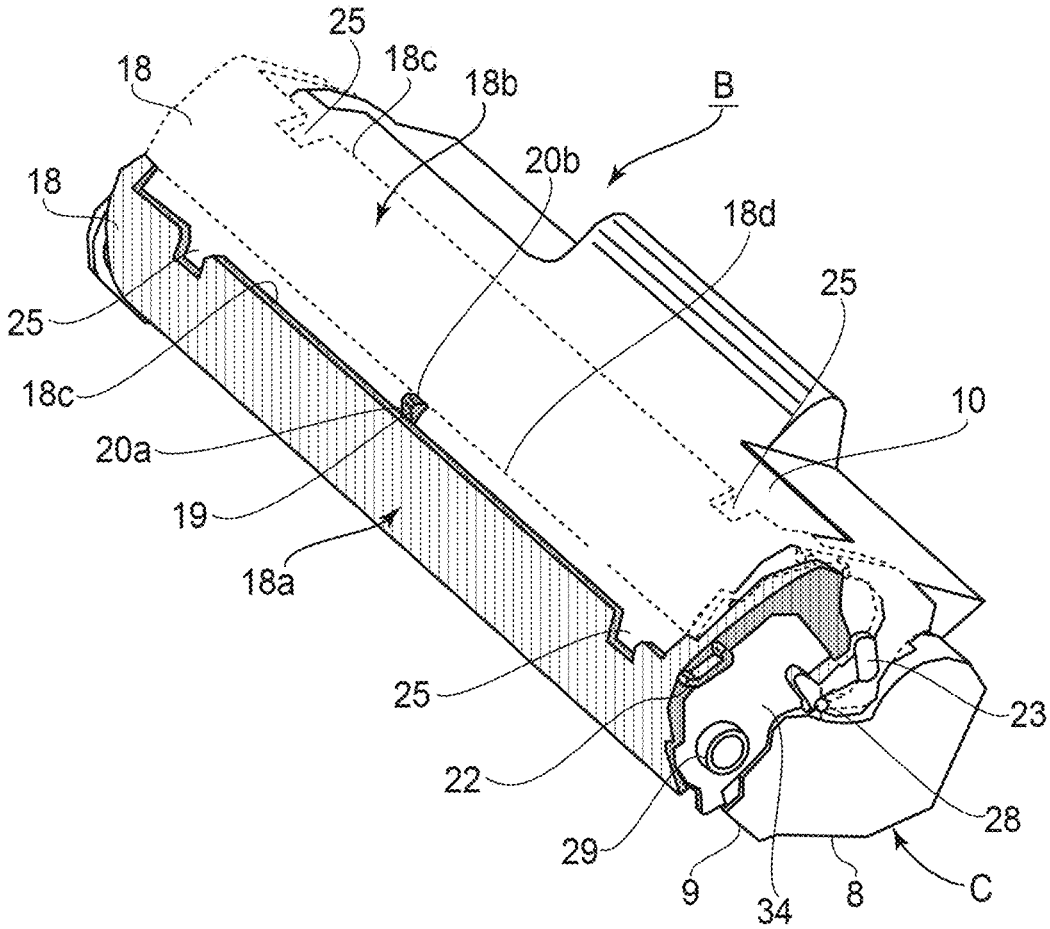
FIG. 1B is a perspective view of the process cartridge in the first preferred embodiment of the present invention, which has a shutter holding means for keeping the shutter closed, and shows the general structure of the cartridge.
Figure 2:
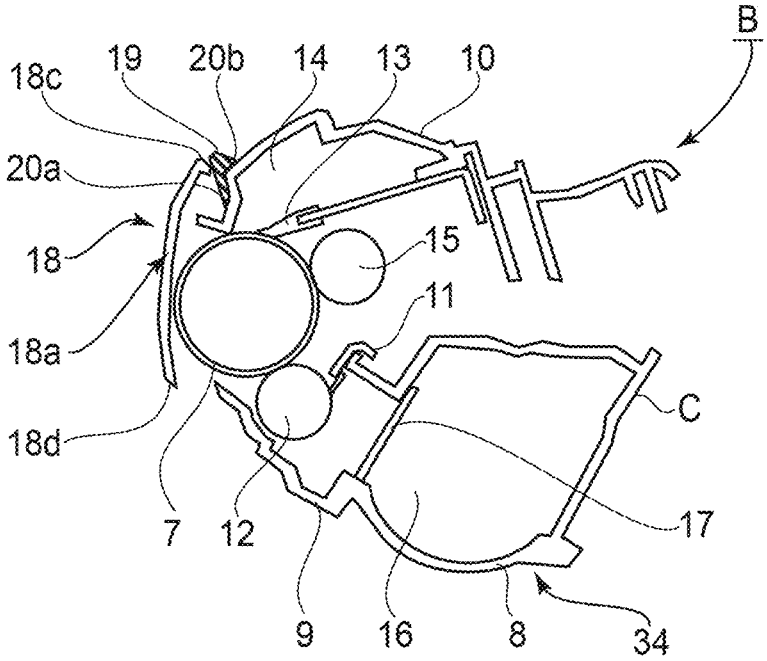
FIG. 2 is a sectional view (a) of the process cartridge in the first embodiment of the present invention, when the shutter of the cartridge is in its position for keeping covered the drum exposure opening of the cartridge, and is a sectional view (b) of the process cartridge in the first embodiment of the present invention when the shutter of the process cartridge is in its position for keeping properly exposed the drum exposure opening of the cartridge.
Figure 2:
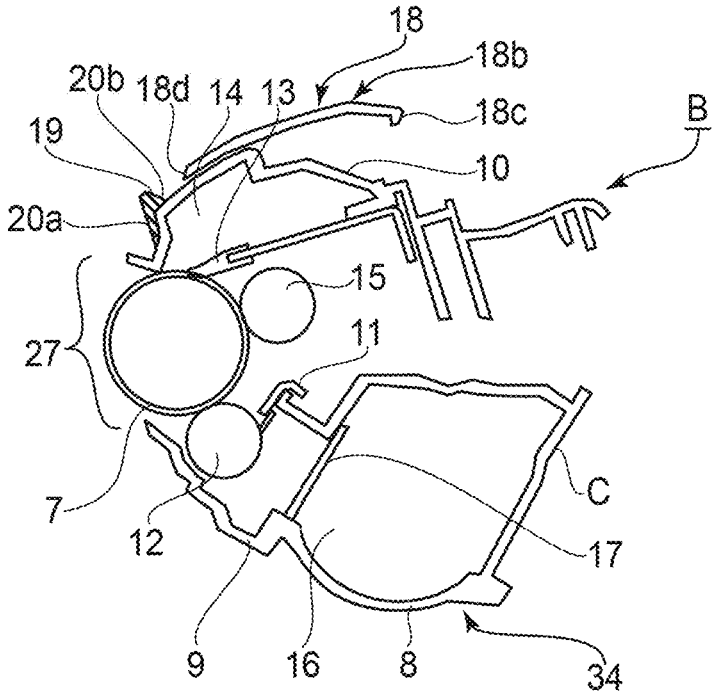

Next, referring to FIG. 1B and FIG. 2, the process cartridge B (which hereafter will be referred to simply as cartridge B) is described. First, referring to FIG. 2, the cartridge B comprises a photosensitive drum unit and a development unit C. The photosensitive drum unit is made up of photosensitive drum 7, a cleaning blade 13, and a drum supporting frame 10 which supports the photosensitive drum 7, cleaning blade 13, etc. The development unit C is made up of a toner chamber 8, developing means such as a development roller 12, and a developing means frame 9 which supports the developing means. The drum supporting frame 10 and developing means supporting frame 9 are in connection with each other in such a manner that they are rotationally movable relative to each other. The cartridge B is structured so that it is removably mountable in the main assembly of an image forming apparatus A (which may be referred to simply as apparatus main assembly, hereafter). The toner chamber 8 has an opening 16. When the cartridge B is brand-new, the opening 16 remains sealed with a seal 17. Thus, when the cartridge B which is brand-new is used for the first time, the seal 17 has to be pulled out to unseal the opening 16. As the material for the seal 17, a sheet or plate of PET (polyethylene-terephthalate, PPS (polyphenylene-sulfide), or the like can be used.

The toner (unshown) in the frame 8 (toner chamber) is sent to the frame 9 (developing means supporting frame) through the opening 16. Then, it is coated on the peripheral surface of the development roller 12 while being formed into a layer of frictionally charged toner, by a development blade 11. Then, the toner particles in the toner layer is transferred onto the peripheral surface of the peripheral surface of the photosensitive drum 7 in the pattern of the electrostatic latent image on the peripheral surface of the photosensitive drum 7. As a result, a visible image is formed of the toner on the peripheral surface of the photosensitive drum 7. Then, the visible image (image formed of toner) is transferred onto the sheet 2 of recording medium by a transfer roller 4, which is shown in FIG. 1A. Then, the toner particles remaining on the peripheral surface of the photosensitive drum 7 are scraped into the waste toner storage chamber 14 by the cleaning blade 13. Then, the portion of the peripheral surface of the photosensitive drum 7, from which the residual toner particles have just been scraped away by the cleaning blade 13, is uniformly charged by a charge roller 15 to be prepared for the formation of a latent image by the optical system 1. The charge roller 15, development roller 12, cleaning blade 13, etc., are the processing means for processing the photosensitive drum 7. The cartridge frame 34 has the frame 8 (toner chamber), frame 9 (developing means supporting frame), and frame 10 (drum supporting frame). It is in the cartridge frame 34 that the photosensitive drum 7 (image bearing member), and the processing means for processing the photosensitive drum 7, are held.

[Structure of Shutter]

Next, referring to FIG. 2 which is a sectional view of the cartridge B, the structure of the shutter 18 is described. The cartridge B has an opening 27, which is between the frame 10 and 9 of the cartridge frame 34. It is through the opening 27 that the photosensitive drum 7 (image bearing member) becomes exposed as the shutter 18 is opened. More specifically, referring to FIG. 1A, the position of the opening 27 relative to the cartridge B is such that when the cartridge B is its image formation position in the main assembly of the image forming apparatus A, it faces downward and allows the photosensitive drum 7 to contact the sheet 2 of recording medium. Further, the cartridge B is provided with the shutter 18 which is elastic. As the cartridge B is mounted into, or removed from, the main assembly of the image forming apparatus A, the shutter 18 is made to expose, or cover, the opening 27 by the movement of the cartridge B.

As the material for the elastic shutter 18, HIPS (high impact polyethylene) can be used, for example. HIPS is a combination of PS (polystyrene) and rubbery polymer or copolymer. Substances selectable as the preferable rubbery copolymer for the shutter 18 are poly-butadiene, styrene-butadiene copolymer, polyisoprene, butadiene-isoprene copolymer, natural rubber, ethylene-propylene copolymer, and the like. By using substances, such as those listed above, which contain rubbery substance(s), as the material for the shutter 18, it is possible to provide the shutter 18 with a greater amount of elasticity than by using substances which have not been increased in elasticity with the addition of rubbery substances. Incidentally, the materials for the shutter 18 do not need to be limited to HIPS. That is, the elastic shutter 18 may be formed of ABS (acrylonitrile-butadiene-styrene copolymer), denatured PPE (denatured polyphenylene-ether resin), for example.

Referring to (a) of FIG. 2, when the cartridge B is brand-new, the shutter 18 keeps the opening 27 completely covered to protect the photosensitive drum 7 (shutter position 18*a* in (a) of FIG. 2). Next, referring to (b) of FIG. 2, the cartridge B is structured so that as the cartridge B is inserted into the main assembly of the image forming apparatus A to be used, the shutter 18 is rotationally moved about a shaft 28, shown in FIG. 1B, to expose the opening 27 so that the photosensitive drum 7 is allowed to contact the sheet 2 of recording medium (shutter position 18*b* in FIG. 2((*b*))).

Referring to FIG. 1B, the cartridge B is structured so that the shutter 18 is rotationally movable about the pair of shafts 28, which project outward from the side walls of the cartridge frame 34 in the lengthwise direction of the cartridge B, one for one, being thereby enabled to move between the closed position 18*a* and open position 18*b*.

[Structure of Shutter Holding Means]

Next, referring to FIGS. 1B and 2, the shutter holding means (shutter holding member) of the cartridge B is described. FIG. 1B is a schematic sectional view of the cartridge B, and FIG. 2((*a*)) is a schematic sectional view of the cartridge B when the shutter 18 is over the opening 27. FIG. 2(*b*) is a schematic sectional view of the cartridge B when the shutter 18 is away from the opening 27.

In this embodiment, the shutter holding means is a projection 19, which is on the outward surface of the frame 10 (drum supporting frame) of the cartridge frame 34. In terms of the lengthwise direction of the cartridge B, the projection 19 is roughly in the middle of the cartridge B. It is perpendicular to the outward surface of the frame 10. The projection 19 holds the shutter 18 in the closed position 18*a* (FIG. 1B and (a) of FIG. 2) when the cartridge B is out of the image forming apparatus A. Further, it holds the shutter 18 in the open position 18*b* (FIG. 1B and (b) of FIG. 2) when the cartridge B is in its image forming position in the main assembly of the image forming apparatus A. The projection 19 may be a simple projection, or in the form of a rib.

Next, referring to FIG. 2, as the cartridge B is inserted into the main assembly of the image forming apparatus A, the shutter 18 is moved upstream in terms of the cartridge insertion direction, over the projection 19 while being elastically deformed, and then, to its open position, exposing thereby the opening 27. On the other hand, as the cartridge B in the main assembly of the image forming apparatus A is moved outward of the main assembly, the shutter 18 is moved upstream in terms of the cartridge extraction direction, over the projection 19, while being elastically deformed, and then, to its closed position 18*a*, covering thereby the opening 27. The shutter 18 is roughly rectangular, and its lengthwise direction is parallel to the lengthwise direction of the cartridge B. Its size is large enough to fully cover the opening 27. Thus, the shutter 18 is enabled to relatively easily bend in the direction perpendicular to its lengthwise direction, being therefore capable of easily moving over the projection 19. Moreover, the projection 19 is shaped so that in terms of its cross section at a plane which is parallel to the moving direction of the shutter 18 and perpendicular to the lengthwise direction of the cartridge B, it is in the form of a parallelepiped, having slanted surfaces 20*a* and 20*b* which are perpendicular to the rotational movement of the shutter 18 about the shaft 28. This structural arrangement reduces the mount of the resistance which the shutter 18 encounters as it moves over the projection 19, and therefore, makes it possible for the shutter 18 to smoothly move.

Referring to (a) of FIG. 2, when the cartridge B is outside the main assembly of the image forming apparatus A, an edge 18*c* of the shutter 18 is in contact with the slanted surface 20*a* of the projection 19. Thus, the shutter 18 is held in its closed position 18*a* by the projection 19.

[Structural Arrangement for Allowing Process Cartridge to be Removably Mounted]

Figure 3:
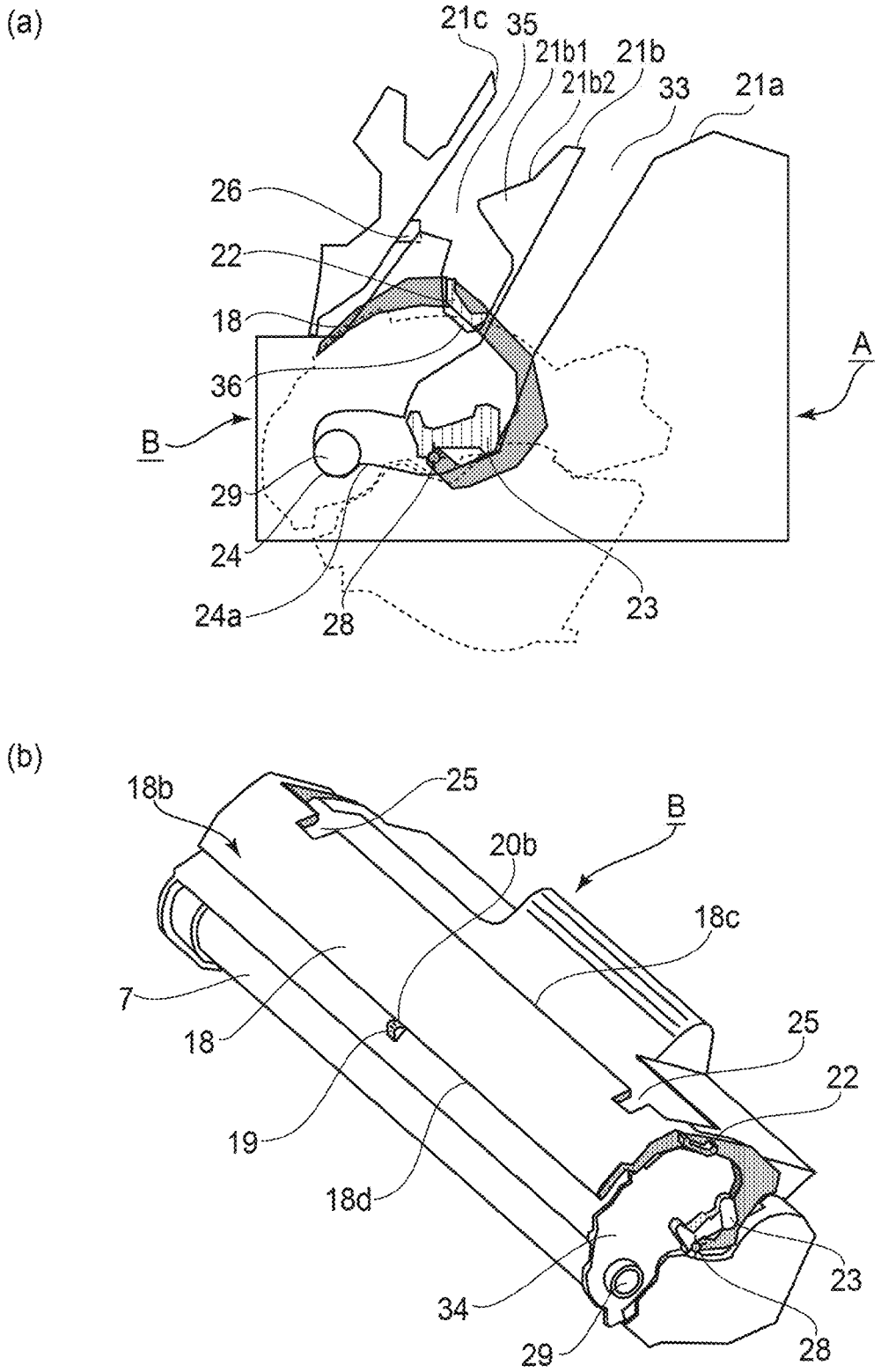
FIG. 3 is a schematic sectional view (a) of the electrophotographic image forming apparatus in the first preferred embodiment of the present invention, and shows the general structure of the cartridge guiding rails and cartridge holding member of the main assembly of the image forming apparatus, and is a perspective view (b) of the process cartridge in the first preferred embodiment of the present invention, and shows the portions of the process cartridge, by which the process cartridge is guided when it is mounted into, or dismounted from, the main assembly of an image forming apparatus.

Next, referring to FIG. 3, the structural arrangement which allows the cartridge B to be removably mounted in the main assembly of the image forming apparatus A is described. FIG. 3(*a*) is a schematic sectional view of the image forming apparatus, and depicts the general structure of the apparatus, in particular, the guide rails 21*a*-21*c* with which the main assembly of the image forming apparatus A is provided to guide the cartridge B when the cartridge B is inserted into the apparatus main assembly, and the shutter catching member with which the main assembly of the image forming apparatus A is provided to close the shutter 18. FIG. 3((*b*)) is a perspective view of the cartridge B, and depicts the structure of the cartridge guide (guiding member) of the cartridge B, which guides the cartridge B when the cartridge B is mounted into, or removed from, the main assembly of the image forming apparatus A.

Referring to FIG. 3(*a*), the cartridge B has a pair of guides, which are on the lengthwise end surfaces of the cartridge frame 34, one for one. The guides correspond in position to the guide rails 21*a*-21*c* of the main assembly of the image forming apparatus A. Next, referring to FIG. 3((*b*)), the shutter 18 is provided with a pair of guide bosses 22, which are on the lengthwise end surfaces of the shutter 18, one for one, and are perpendicular to the end surfaces. Further, the cartridge B is provided with a pair of guide ribs and a pair of cartridge positioning bosses 29, which also are on the lengthwise end surfaces of the cartridge frame 34, one for one, and are perpendicular to the end surfaces.

The method for mounting the cartridge B into the main assembly of the image forming apparatus A is as follows: First, the cartridge B is to be positioned relative to the main assembly of the image forming apparatus A so that the positioning bosses 29 and guide ribs 23 align with the first guide grooves 33 which the guide rails 21*a* and guide rails 21*b* form, and also, so that the guiding bosses 22 align with the second guide grooves 35 which the guide rails 21*b* and guide rail 21*c* form. Then, the cartridge B is inserted into the main assembly of the image forming apparatus A in such a manner that the positioning bosses 29 and guide ribs 23 follow the guide rails 21*a* and 21*b*, whereas the guide bosses 22 follow the guide rails 21*b* and 21*c*. Thus, as the cartridge B is moved into the main assembly of the image forming apparatus As described above, it dives into the space below the optical system 1 of the image forming apparatus A.

The guide rail 21*b* is provided with a projection 21*b*1, which is near the outward end of the guide rail 21*b*, and which is triangular in cross section. Thus, as the cartridge B is inserted further into the main assembly of the image forming apparatus A, the guide boss 22 slides on the outward slanted surface 21*b*2 of the projection 21*b*1, whereas the positioning boss 29 and guide rib 23 follow the first guide groove 33. Then, as the cartridge B is inserted further into the main assembly of the image forming apparatus A, the shutter 18, which was in its closed position, is rotationally moved about the shaft 28, being thereby moved over the projection 19 while being elastically deformed, into its open position 18*b*. Then, the positioning boss 29 fits into the recess 24 (receptacle for positioning boss 29) which is at the end of the first guide groove 33, whereby the cartridge B is precisely position relative to the main assembly of the image forming apparatus A. As for the shutter, 18, as the guide boss 22 fits into the recess 36, which is at the inward end of the second guide groove 35, whereby the shutter 18 is placed in its open position 18*b* as shown in FIG. 2((*b*)). Further, as the guide boss 22 fits into the recess 36, the shutter 18, which was remaining elastically deformed, regains its normal shape. Therefore, the other edge 18*d* of the shutter 18 is caught by the projection 19, whereby the shutter 18 is retained in its open position 18*b* (FIG. 3((*b*))).

More specifically, the outward surface (slanted) 21*b*2 of the projection 21*b*1 of the guide rail 21*b*, and the recess 36 (receptacle) of the guide rail 21*b*, are the portions of the main assembly of the image forming apparatus A, which engage with the shutter 18 (guide boss 22) when the cartridge B is mounted into the main assembly of the image forming apparatus A. It is these portions that keep the shutter 18 elastically deformed while the shutter 18 is moved into its open position 18*b*. Since the cartridge B and the main assembly of the image forming apparatus A are structured as described above, as the shutter 18 is rotationally moved to expose the opening 27, it can be moved over the projection 19 while being elastically deformed. That is, the height of the projection 19 is such that it allows the shutter 18 to be moved from its closed position to its open position while causing the shutter 18 to elastically deform by the correct amount.

Figure 4:
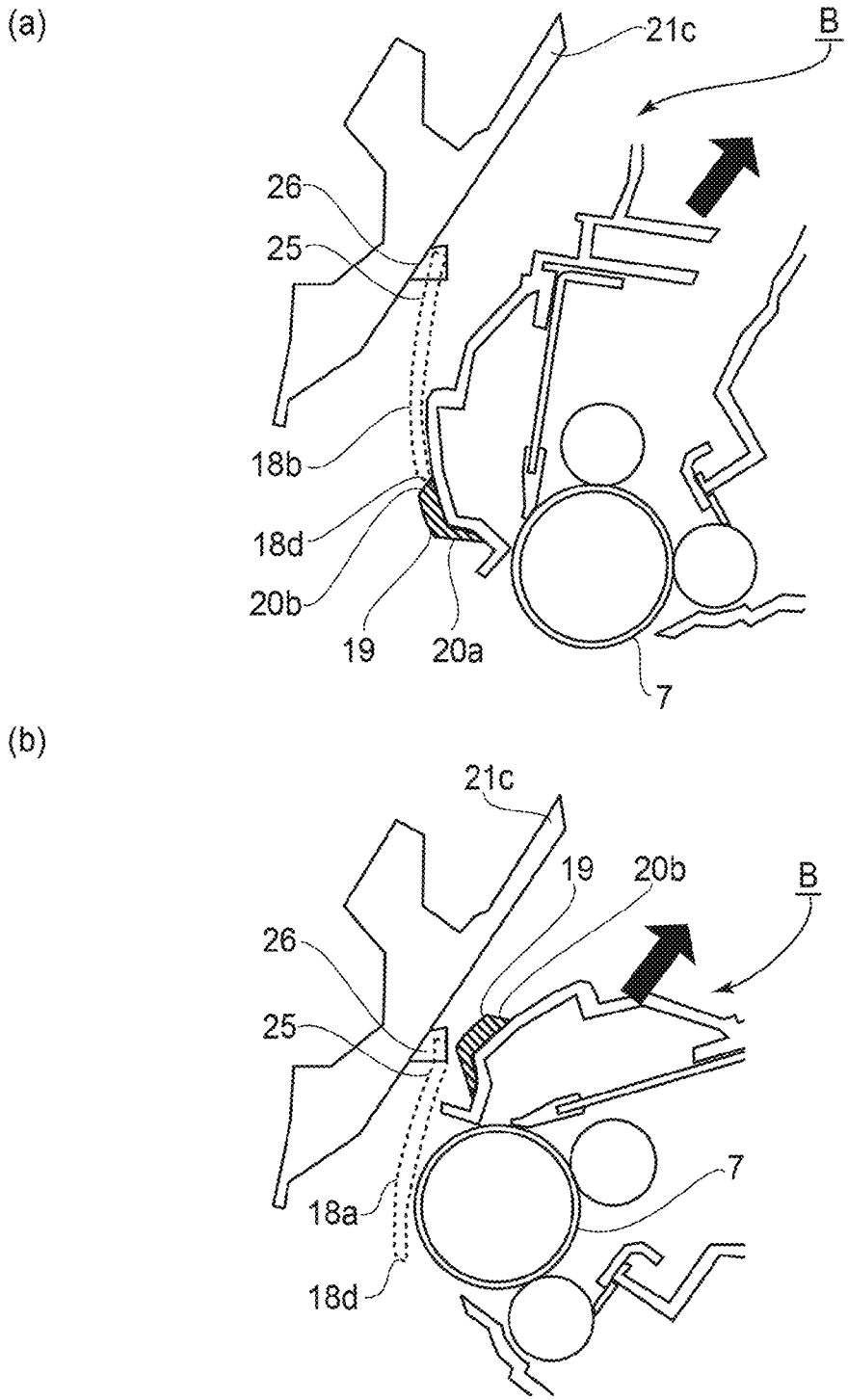
FIG. 4 is a schematic sectional view of the shutter, and its adjacencies, of the process cartridge in the first preferred embodiment, and depicts the mechanism for closing the shutter as the process cartridge is moved out of the main assembly of the electrophotographic image forming apparatus.

Next, referring to FIGS. 3 and 4, the operation for extracting the cartridge B from the main assembly of the image forming apparatus A is described. First, the cartridge B is to be pulled outward in the direction parallel to the guide rails 21*a* and 21*b* so that the positioning boss 29 in the recess 24, which is at the inward end of the first guide groove 33, comes out of the recess 24 and moves onto the portion 24*a* of the first guide groove 33, which is immediately adjacent to the recess 24. As the cartridge B comes out of the recess 24 as described above, it is to be pulled diagonally upward so that the guide rib 23 and guide boss 22 follow the guide rails 21*a* and 21*b* as they did when the cartridge B was inserted. The upstream edge portion 18*c* of the shutter 18, in terms of the direction in which the shutter 18 is rotationally moved to expose the opening 27, has a pair of recesses 25 which function as a catch, whereas each of the guide rails 21*c* has a projection 26 which functions a hook, and the position of which corresponds to that of the recess 25.

Thus, the cartridge B is to be pulled diagonally upward so that the guide rib 23 and positioning boss 29 follow the guide rail 21*a* and 21*b*, and also, so that the guide boss 22 follows the guide rail 21*b*. Next, referring to FIG. 4((*a*)), each of the pair of guide rails 21 of the main assembly of the image forming apparatus A has a projection 26 (catching portion). Thus, as the cartridge B is pulled outward as described above, each projection 26 begins to engage into the corresponding recess 25 of the shutter 18. Then, as the cartridge B is pulled further outward, the shutter 18 is caused to move over the projection 19 while being elastically deformed. The projection 26 remains engaged in the recess 25 until the shutter 18 reaches its closed position 18*a* (FIG. 4((*b*))). Then, as the shutter 18 is moved into its closed position 18*a*, the projection 26 comes out of the recess 25. Therefore, the shutter 18 is allowed to restore its normal shape, causing its edge 18*c* to come into contact with the slanted surface 20*a* of the projection 19, as shown in FIG. 2((*a*)). Thus, the shutter 18 is retained in its closed position 18*a* by the projection 19. In other words, while the cartridge B is removed from the main assembly of the image forming apparatus A, the shutter 18 is closed by the outward movement of the cartridge B.

Forming the projections 19 as an integral part of the cartridge frame 34 as described above can reduce the process cartridge B in component cost. Further, positioning the projection 19 roughly at the center of the cartridge B in terms of the lengthwise direction of the cartridge B makes it possible to prevent the shutter 18 from being twisted as it is opened or closed, and also, to improve the main assembly of the image forming apparatus A in the spatial efficiency; it can reduce the image forming apparatus in the internal space necessary for the mounting and dismounting of the cartridge B.

[Embodiment 2]

Figure 5:
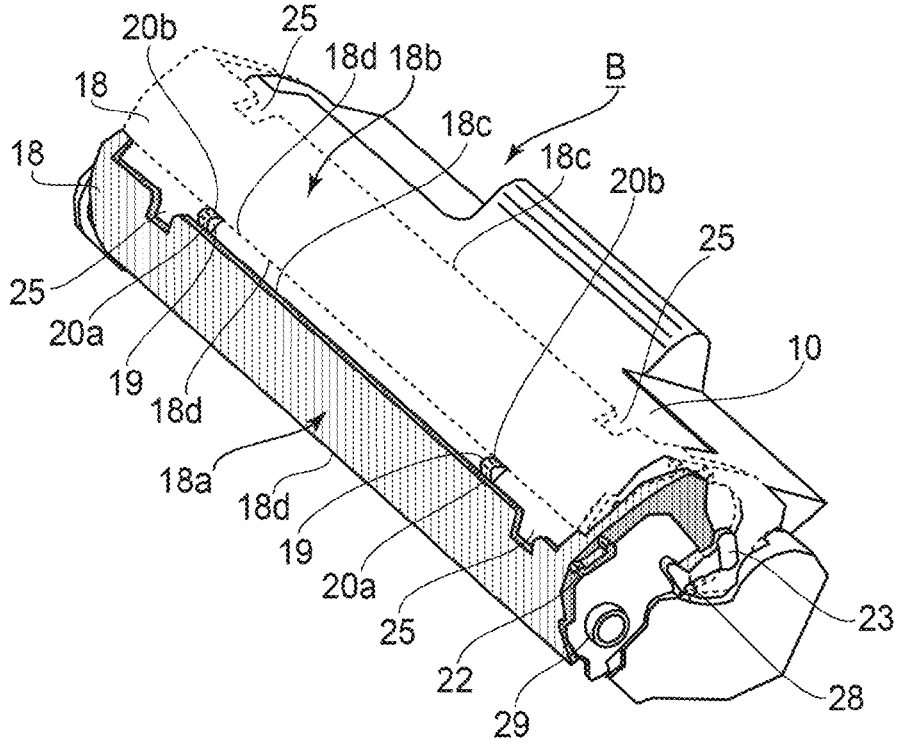
FIG. 5 is a perspective view (a) of the process cartridge in the second preferred embodiment of the present invention, which has two shutter holding means. It depicts the process cartridge when the shutter is in its closed position, and is a sectional view (b) of the process cartridge in the second preferred embodiment of the present invention.
Figure 5:
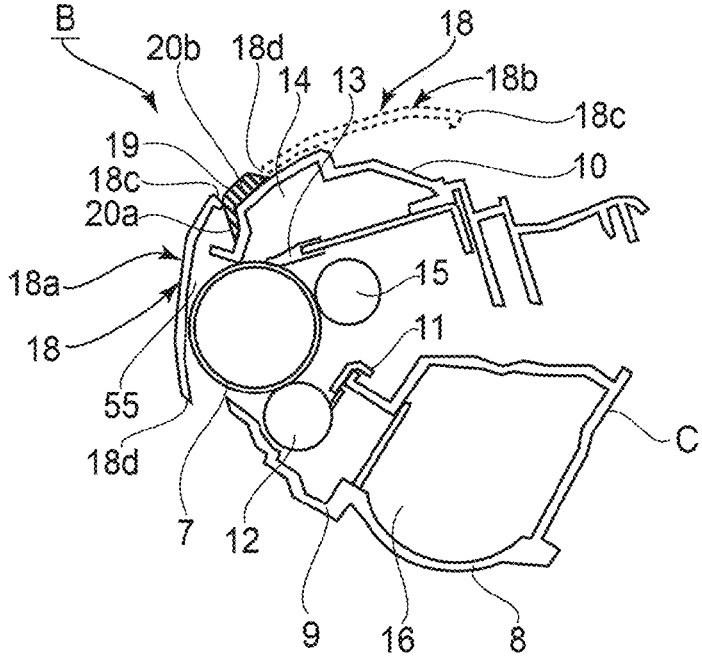

Next, referring to FIG. 5, the second preferred embodiment of the present invention is described. In the first preferred embodiment, a single projection 19 was at roughly the center of the cartridge B in terms of the lengthwise direction of the cartridge B. In this embodiment, the cartridge B is provided with two projections 19, which are near the lengthwise ends of the cartridge B, one for one.

Referring to FIG. 5((*a*)), each projection 19 is on the outward surface of the frame 10 (drum supporting frame). Not only does it hold the shutter 18 in the closed position 18*a* of the shutter 18 when the cartridge B is out of the main assembly of the image forming apparatus A, but also, in the open position 18*b* of the shutter 18 when the cartridge B is its image forming position in the main assembly of the image forming apparatus. As the cartridge B is inserted into the main assembly of the image forming apparatus A, the shutter 18 exposes the opening 27 by being made to rotationally moved about the shaft 28, moving over the projections 19 while being elastically deformed, whereas as the cartridge B is pulled outward when it is in the apparatus main assembly, the shutter 18 covers the opening 27 by being made to rotationally moved about the shaft 28, moving over the projections 19 while being elastically deformed.

The operation for mounting the cartridge B in this embodiment into, or removing it from, the main assembly of the image forming apparatus is the same as the operation for mounting the cartridge B in the first preferred embodiment into, or removing it from the main assembly of the image forming apparatus, and therefore, is not described.

Since the cartridge B in this embodiment is provided with the pair of projections 19 which are in the adjacencies of the lengthwise ends of the cartridge B, one for one, it is unlikely for the shutter 18, which is elastically flexible, to be twisted while the shutter 18 is opened or closed. Therefore, the shutter 18 is unlikely to interfere with a part or parts of the main assembly of the image forming apparatus A while the cartridge B is mounted into, or removed from, the main assembly. Also in this embodiment, when the shutter 18 is in its closed position 18*a*, it is held by the lengthwise end portion of its long edge portion of 18*c* by the slanted surface 20*a* of each of the two projections 19, whereas when it is in its open position 18*b*, it is held at by the lengthwise end portions of its long edge 18*d* by the slanted surface 20*b* of each of the two projections 19. Therefore, the shutter 18 in this embodiment is prevented from rattling. Therefore, it does not occur that the shutter 18 makes noises by resonating with the vibrations which result from the driving of the image forming apparatus A. Incidentally, the number of the projections 19 with which the cartridge B is provided may be three or more. Further, although the preceding preferred embodiments of the present invention were described with reference to a cartridge comprising a photosensitive drum, and processing means for processing the photosensitive drum, the present invention is also compatible with a drum cartridge, that is, a cartridge having only a photosensitive drum.

[Effects of Invention]

The present invention makes it possible to hold the shutter of a cartridge without providing the cartridge (shutter) with a pressure applying means or the like dedicated to shutter retention. Thus, not only can the present invention reduce a cartridge in component count, but also, simplify the process of assembling a cartridge with a shutter.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 004591/2010 and 274388/2010 filed Jan. 13, 2010 and Dec. 9, 2010, respectively, which are hereby incorporated by reference.

What is claimed is:

1. A cartridge detachably mountable to a main assembly of an image forming apparatus, said cartridge comprising:

an image bearing member;

a frame having an opening for exposing said image bearing member;

a movable shutter member movable between a closed position for closing said opening and an open position for opening said opening; and a holding portion for abutting to said shutter member to hold said shutter member at the closed position, wherein said shutter member is elastically deformable to ride over said holding portion to permit said shutter member to move from the closed position to the open position, wherein said holding portion abuts to said shutter member to keep said shutter member in the open position, and wherein said shutter member is elastically deformed by said holding portion to ride over said holding portion so that said shutter member moves from the open position to the closed position.

2. A cartridge according to claim 1, wherein said holding portion is provided on said frame.

3. A cartridge according to claim 2, wherein said holding portion includes a projection projecting from said frame, said projection having a height capable of being ridden over by said shutter member.

4. A cartridge according to claim 1, wherein said holding portion is disposed adjacent a center portion with respect to a longitudinal direction of said cartridge.

5. A cartridge according to claim 1, wherein said holding portion is provided at each of two or more positions.

6. A cartridge according to claim 1, wherein said shutter member contacts the main assembly of the apparatus to move from the open position to the closed position when said cartridge is removed from the main assembly of the apparatus.

7. A cartridge according to claim 1, wherein said cartridge is a process cartridge including process means actable on said image bearing member.

8. A cartridge according to claim 1, wherein said movable shutter member is provided with a contacting portion that is contactable to the main assembly of said apparatus to receive a force for moving said movable shutter member from the open position to the closed position when said cartridge is dismounted from the main assembly.

9. A cartridge according to claim 1, wherein said movable shutter member is provided with a contacting portion that is contactable to the main assembly to receive a force for moving said movable shutter member from the closed position to the open position when said cartridge mounted to the main assembly.

10. An image forming apparatus for forming an image on a recording material, said apparatus comprising:

(a) mounting portion;

(b) a cartridge detachably mountable to said mounting portion, said cartridge including:

an image bearing member;

a frame having an opening for exposing said image bearing member;

a movable shutter member movable between a closed position for closing said opening and an open position for opening said opening; and a holding portion for abutting to said shutter member to hold said shutter member at the closed position, wherein said shutter member is elastically deformable to ride over said holding portion to permit said shutter member to move from the closed position to the open position, wherein said holding portion abuts to said shutter member to keep said shutter member in the open position, and wherein said shutter member is elastically deformed by said holding portion to ride over said holding portion so that said shutter member moves from the open position to the closed position.

11. An image forming apparatus according to claim 10, wherein said holding portion includes a projection projecting from said frame, said projection having a height capable of being ridden over by said shutter member.

12. An apparatus according to claim 10, further comprising an engaging portion for moving said shutter member from the closed position to the open position when said cartridge is mounted to a main assembly of said image forming apparatus.

13. An apparatus according to claim 10, further comprising an engaging portion for moving said shutter member from the open position to the closed position when said cartridge is demounted to a main assembly of said image forming apparatus.

14. An image forming apparatus according to claim 10, wherein said movable shutter member is provided with a contacting portion that is contactable to a main assembly of said apparatus to receive a force for moving said movable shutter member from the open position to the closed position when said cartridge is dismounted from said main assembly.

15. An apparatus according to claim 10, wherein said movable shutter member is provided with a contacting portion that is contactable to a main assembly of said apparatus to receive a force for moving said movable shutter member from the closed position to the open position when said cartridge mounted to said mounting portion.

* * * * *